US007027015B2

(12) United States Patent
Booth, Jr. et al.

(10) Patent No.: US 7,027,015 B2
(45) Date of Patent: Apr. 11, 2006

(54) COMPENSATING ORGANIC LIGHT EMITTING DEVICE DISPLAYS FOR COLOR VARIATIONS

(75) Inventors: Lawrence A. Booth, Jr., Phoenix, AZ (US); Robert F. Kwasnick, Palo Alto, CA (US)

(73) Assignee: Intel Corporation, Santa Clara, CA (US)

( * ) Notice: Subject to any disclaimer, the term of this patent is extended or adjusted under 35 U.S.C. 154(b) by 697 days.

(21) Appl. No.: 09/945,031

(22) Filed: Aug. 31, 2001

(65) Prior Publication Data

US 2003/0043088 A1 Mar. 6, 2003

(51) Int. Cl.
*G09G 3/32* (2006.01)

(52) U.S. Cl. ..... 345/83; 345/82; 345/690

(58) Field of Classification Search ..... 345/82, 345/83, 81, 76, 77, 204, 205; 315/169.1, 315/169.3; 313/506, 500
See application file for complete search history.

(56) References Cited

U.S. PATENT DOCUMENTS

| | | | | |
|---|---|---|---|---|
| 5,532,550 | A * | 7/1996 | Adler | 313/500 |
| 6,097,367 | A * | 8/2000 | Kuriwaki et al. | 345/589 |
| 6,120,909 | A * | 9/2000 | Bojarczuk et al. | 428/446 |
| 6,285,124 | B1 * | 9/2001 | Nagayama et al. | 313/506 |
| 6,313,816 | B1 * | 11/2001 | Kojima et al. | 345/83 |
| 6,486,923 | B1 * | 11/2002 | Maeshima et al. | 348/649 |
| 6,501,230 | B1 * | 12/2002 | Feldman | 315/169.3 |
| 6,639,574 | B1 * | 10/2003 | Scheibe | 345/83 |

* cited by examiner

*Primary Examiner*—Xiao Wu
(74) *Attorney, Agent, or Firm*—Trop, Pruner & Hu, P.C.

(57) ABSTRACT

An organic light emitting device display may be compensated for color variations between sub-pixels of the same expressed color. This may be done initially upon manufacture of the display and may be continued and updated in the course of the display's lifetime to compensate for differential effects of aging on different expressed sub-pixels. In accordance with one embodiment of the present invention, the display may be driven to achieve a color gamut that substantially all of the pixels are capable of achieving.

18 Claims, 5 Drawing Sheets

COMPENSATING ORGANIC LIGHT EMITTING DEVICE DISPLAYS FOR COLOR VARIATIONS

BACKGROUND

This invention relates generally to organic light emitting device (OLED) displays that have light emitting layers that are semiconductive polymers or small molecules.

OLED displays use layers of light emitting materials. Unlike liquid crystal devices, the OLED displays actually emit light, making them advantageous for many applications.

OLED displays may use either at least one semiconductive conjugated polymer or a small molecule sandwiched between a pair of contact layers. The contact layers produce an electric field that injects charge carriers into the OLED layer. When the charge carriers combine in the OLED layer, the charge carriers decay and emit radiation in the visible range.

It is believed that some OLED compounds containing vinyl groups tend to degrade over time and use due to oxidation of the vinyl groups, particularly in the presence of free electrons. Since driving the display with a current provides the free electrons in abundance, the lifetime of the display is a function of applied current between an anode and cathode. Newer compounds based on fluorine have similar degradation mechanisms that may be related to chemical purity, although the exact mechanism is not yet well known in the industry.

In general, OLED displays have a lifetime limit related to the total integrated charge passed through the display. Thus, the luminance of OLED displays generally decreases with use. In order to achieve a desired luminance for a given pixel at a given time in the course of the display's lifetime, the OLED luminance versus current characteristics for a particular manufacturing process are well characterized as a function of aging. For a given total integrated charge, the device current needed to achieve a specific luminance is therefore known.

A matrix display comprises many individually addressable pixels. For a particular type of emissive display comprising OLEDs, each pixel comprises OLED devices addressed by rows and columns. Colors are typically implemented in an OLED display by incorporating in each pixel, individually addressable "sub-pixels" of red, green, and blue.

The primary colors in a linear physical intensity color space, such as the Commission Internationale de l'Eclairage (CIE) xy (1931), form a color gamut which, in some cases, inscribe the vertices of a triangle. Any coordinate inscribed by the gamut identifies a color that can be represented by the scaling of the intensity of each primary color. Embodiments of the present invention are applicable to color spaces that include three or more colors.

The human eye is sensitive to color differences. The perceptible difference between two colors can be described within the well known CIE "color space" which is represented as a plane diagram in units of )-C*, where one )-C* is the just noticeable difference (the color difference in units of x-y which is just noticeable varies depending on the x-y coordinates of the color).

In the course of aging, the luminance for a given drive current decreases non-linearly. Moreover, the nature of the change of luminance over lifetime is more complex than even the non-linear relationship between luminance and drive current. In addition, individual colors change differently in the course of display lifetime. Thus, simply changing the drive current to achieve a desired characteristic luminance may be insufficient. For example, color variations between the many pixels may become perceptible, creating the distracting artifact known as fixed pattern noise. Thus, if, initially or at any time thereafter, sub-pixels of a given color are not exactly the same, fixed pattern noise may arise.

In addition, in the course of aging, the individual sub-pixels may change color differently as a result of aging. If the OLED colors change during aging and all the sub-pixels do not age in substantially the same way, a color difference may become perceptible. This may be especially problematic in an application where static images are displayed including displays utilized for signs.

Thus, there is a need for a better way to compensate for static and dynamic changes in color from sub-pixel to sub-pixel in OLED displays.

DETAILED DESCRIPTION

Figure 1:
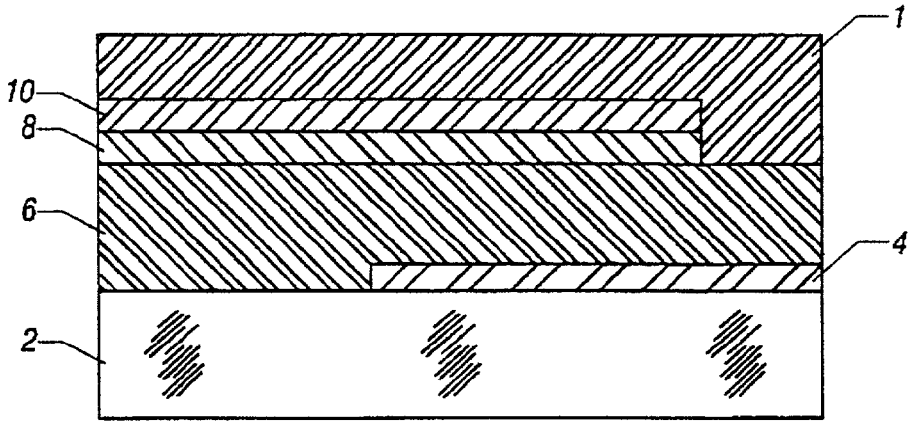
FIG. 1 is an enlarged cross-sectional view of a pixel useful in one embodiment of the present invention.

In one embodiment of the present invention, an organic light emitting device (OLED) display may include a pixel formed of three distinct color emitting layers. Colors may be produced, in one embodiment, by operating more than one of the layers to provide a "mixed" color or different colors may be produced in a time sequenced pattern so that one pixel may be provided with three color planes using a single compound polymer element. A display of the type shown in FIG. 1 is disclosed in U.S. Pat. No. 5,821,690 to Martens et al. and assigned to Cambridge Display Technology Limited. Other OLED display technologies may also be utilized in connection with the present invention. Embodiments of the present invention may use stacked red, green, blue structures, or side by side red, green and blue sub-pixels. Other color spaces may be used as well.

Referring to FIG. 1, a transparent substrate 2 supports the remaining layers and transmits the output light from the light emitting material. A layer of transparent conductive material such as indium tin oxide 4 may be deposited on the substrate 2 and etched to have a reduced size compared to the dimensions of the substrate 2. An emissive organic layer 6 may be deposited over the transparent conductive layer 4. The layer 6 may be a semiconductive conjugated polymer in one embodiment of the invention. Other embodiments may use evaporated small molecule films. A contact layer 8 may be deposited over the organic layer 6 to provide the second electrode so an electric field may be applied to the layer 6 by the electrodes 8 and 4. The electrode 8, in one embodiment of the present invention, may be formed of calcium that may be deposited by evaporation through a mask.

On top of the electrode layer 8, a conductive layer 10 is arranged to overlie the layer 8 so that the layers 8 and 10 overlap the layer 4. Again, the layer 10 may be defined using evaporation through a mask. In some embodiments, the organic layer 6 may be made up of a sequence of more than one material, each providing a unique functionality to the OLED structure. The particular choice of the combination of organic layers will determine the color output of the pixel. The overall OLED structure may be covered by a coating 1 to protect the diode from the effects of the ambient.

In the same manner as shown in FIG. 1, other sub-pixels may be formed with other combinations of organic materials to produce a range of colors. In one embodiment, a pixel consists of three sub-pixels that emit red, green and blue lights, respectively.

Figure 2:
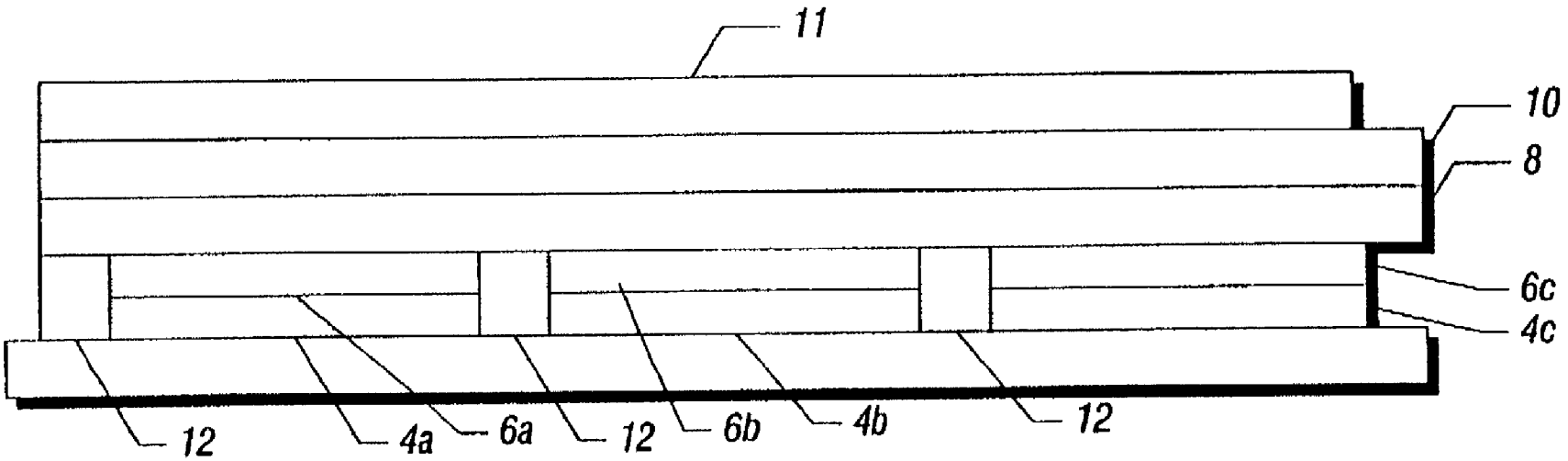
FIG. 2 is an enlarged cross-sectional view of another embodiment of the present invention.

As shown in FIG. 2, in one embodiment, the three sub-pixels have individual indium tin oxide (ITO) electrodes 4*a*, 4*b*, and 4*c*, unique organic layers 6*a*, 6*b*, 6*c*, and a common calcium/aluminum electrode 8, 10. In this case, the sub-pixels may be separated by an isolation layer 12.

Figure 3:
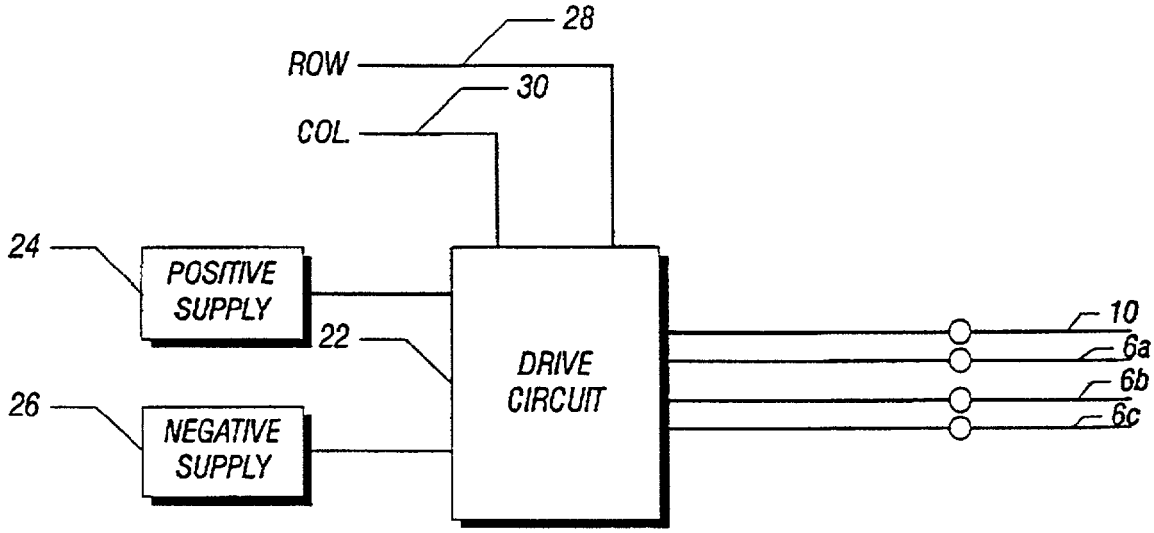
FIG. 3 is a schematic diagram of the drive circuitry that may be utilized with the embodiment shown in FIG. 1.

The various control electrodes 10, 4*a*, 4*b*, and 4*c*, may be coupled to a drive circuit 22 as shown in FIG. 3. The drive circuit 22, under control of the row 28 and column 30 address signals, selectively applies positive supply voltage 24 to a selected electrode 4*a*, 4*b* or 4*c* and a lower potential or negative potential voltage 26 to a selected electrode 10. As a result, electrical fields may be selectively applied to the light emitting layers 6*a*, 6*b*, or 6*c* in FIG. 2.

Figure 5:
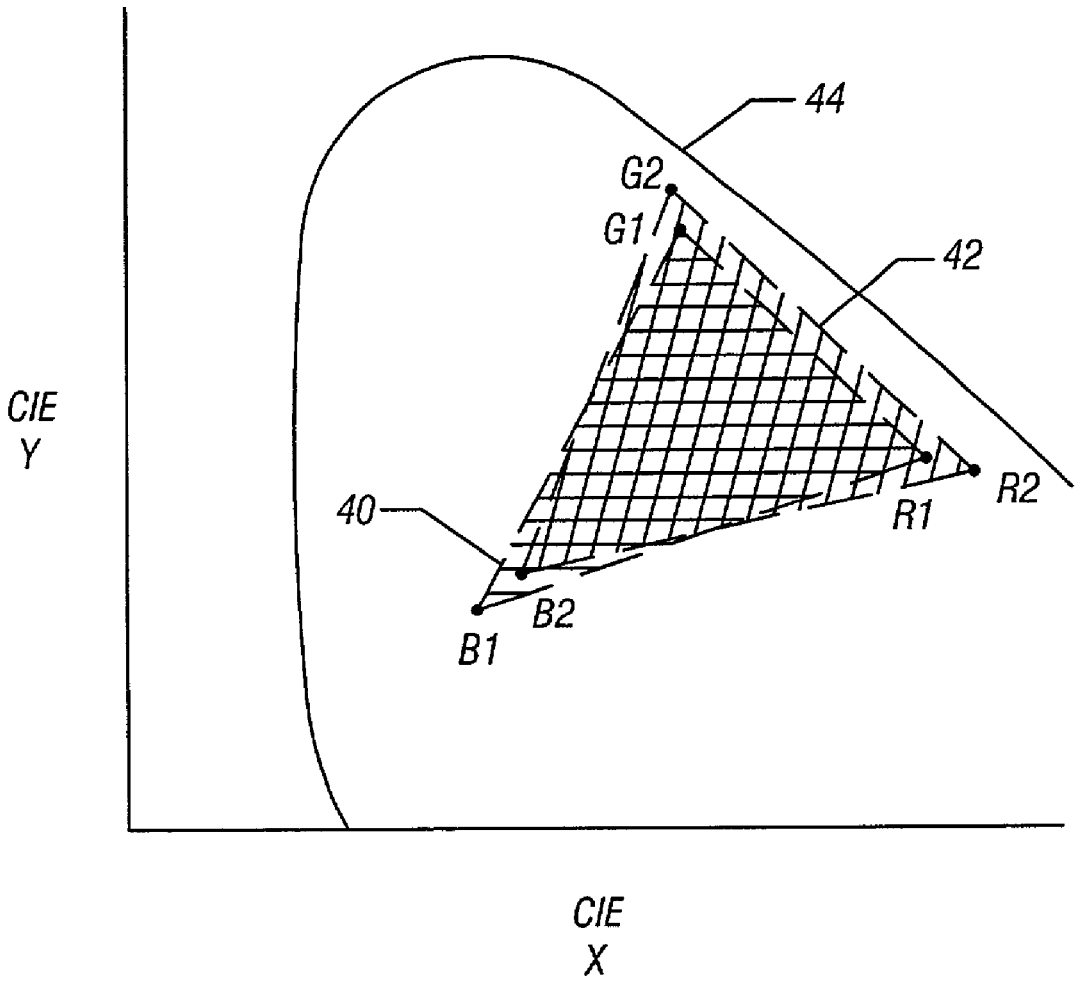
FIG. 5 is a flow chart in accordance with one embodiment of the present invention.

Referring to FIG. 5, a CIE x-y color chart for a hypothetical display illustrates the human visual response 44 at which colors are maximally saturated. An initial color gamut 40 is made up of the points G1, R1, and B1. During product life, the green color G1 sub-pixels move away from the represented gamut to the point G2. Similarly, the red sub-pixels R1 tend to move away from the original gamut 40 to the position R2. Finally the blue pixel B1 moves into the original gamut 40 as indicated at B2. Thus, in this hypothetical representation, it is seen that generally the sub-pixels of different colors may age in different ways from the triangle 40 to the aged gamut 42.

A problem arises that individual sub-pixels which should have been initially of the same color are not and variations in color within sub-pixels designated the same color may result in a degraded display appearance. Moreover, given sub-pixels may age at different rates and thus the color shift between various sub-pixels designated to be the same color may change over their lifetime. For a given display, the color of each sub-pixel is characterized in the factory as part of the final test before shipping. The expressed color of each sub-pixel is set to the smallest color gamut for the population of sub-pixels. In other words, the emitted color from each sub-pixel is limited to the smallest color gamut which all of the sub-pixels of that color in the display can achieve.

While this approach sacrifices the potential color gamut possible with a given display, it assumes substantial uniformity. In some embodiments, some color variation may be tolerated. In such case, instead of using the smallest gamut that is achievable by all of the pixels, a slightly larger gamut may be utilized. For example, a gamut having an area of 10%–20% larger than the smallest gamut may be utilized in some embodiments where some color variation is tolerable.

The color aging behavior of a given OLED technology manufacturing process may be statistically well characterized. For processes where there is significant color aging, the color triangle may be set at any time during the lifetime of the display at either the smallest color set that can be achieved by all or substantially all of the sub-pixels at any time during the expected display lifetime. In this way, even if the colors for a particular set of sub-pixels age differentially, and those sub-pixels are used faster than other sub-pixels, the display still appears to be relatively uniform in color.

Fractional components of the other sub-pixel colors may be utilized to bring the color of the expressed sub-pixel to a relatively small color gamut that all or substantially all of the sub-pixels can achieve. Thus, for example, red and/or blue may be utilized to alter the expressed color of the green sub-pixel. The same may be done to the red and blue sub-pixels. As a result, the sub-pixels of a tricolor space such as red, green, and blue color space may each generate a three component vector resulting in a three by three matrix for each pixel that calibrates the initial color of the smallest color gamut. If the colors of the sub-pixels change with age, compensation for that aging may involve taking each of nine components of the three by three matrix and treating each as time dependent, with that time being a function of the measure of aging of each sub-pixel.

The components of the matrix may be color mixing ratios. These components may be calculated through techniques well known in the art. The ratios may be based on the characterized color aging behavior of each sub-pixel. However, algorithmically, the aging of the pixels is then tracked. The color correction fraction is the sub-pixel colors needed to maintain a given expressed pixel color relatively constant at the smallest or at least a relatively small color gamut.

Throughout the display's lifetime, to achieve a specific color, the drive current to each sub-pixel within a given pixel may be multiplied by the mixing matrix. In addition, other possible adjustment factors related to the transfer function between drive current and color as a function of aging may be applied as well.

Figure 6:
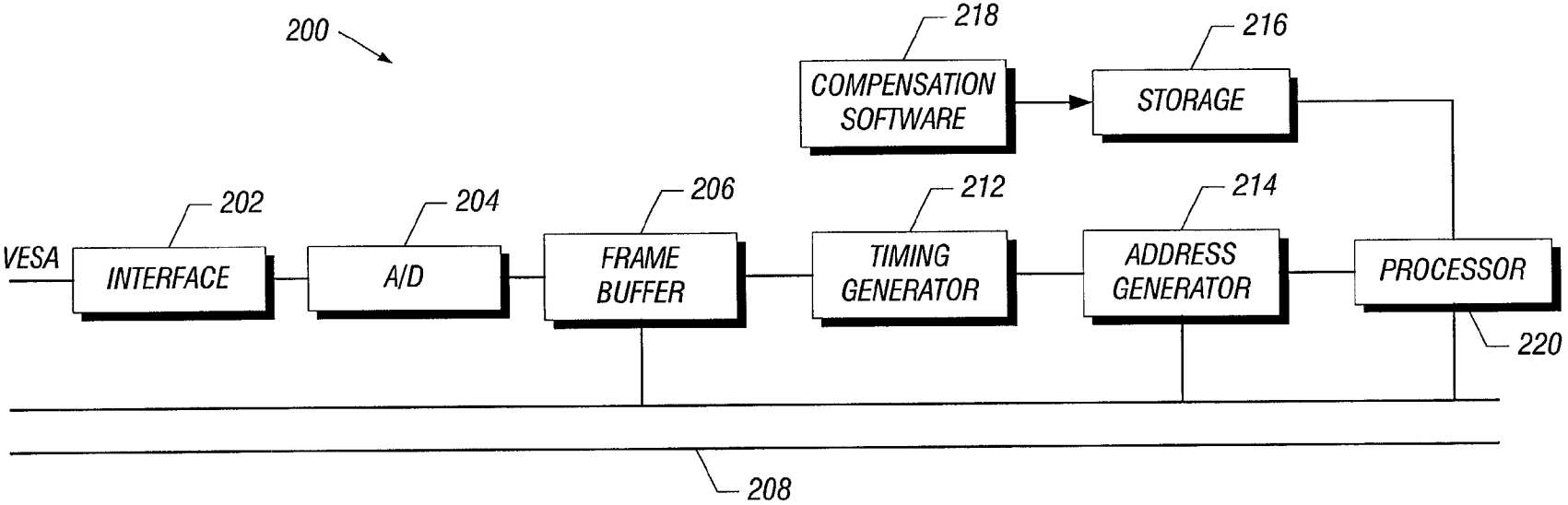
FIG. 6 is a block diagram of a system for implementing one embodiment of the present invention.

Referring to FIG. 6, the display may include an electrical system 200 that may be part of a computer system, for example, or part of a stand-alone system. In particular, the electrical system 200 may include a Video Electronic Standard Association (VESA) interface 202 to receive analog signals. Other interfaces may be used as well. The VESA standard is further described in the Computer Display Timing Specification, V.1, Rev. 0.8 (1995). These analog signals indicate images to be formed on the display and may be generated by a graphics card of a computer, for example. The analog signals are converted into digital signals by an analog-to-digital (A/D) converter 204, and the digital signals may be stored in a frame buffer 206. A timing generator 212 and an address generator 214 may be coupled to the frame buffer 206 to regulate a frame rate by which images are formed on the screen. A processor 220 may be coupled to the frame buffer 206 via a bus 208.

The storage 216 may store the software 50 that is responsible for achieving the color compensation algorithm described previously. Thus, the processor 220 in one embodiment may execute software to implement the color compensation. In other embodiments, hardware compensation may be utilized.

Figure 4:
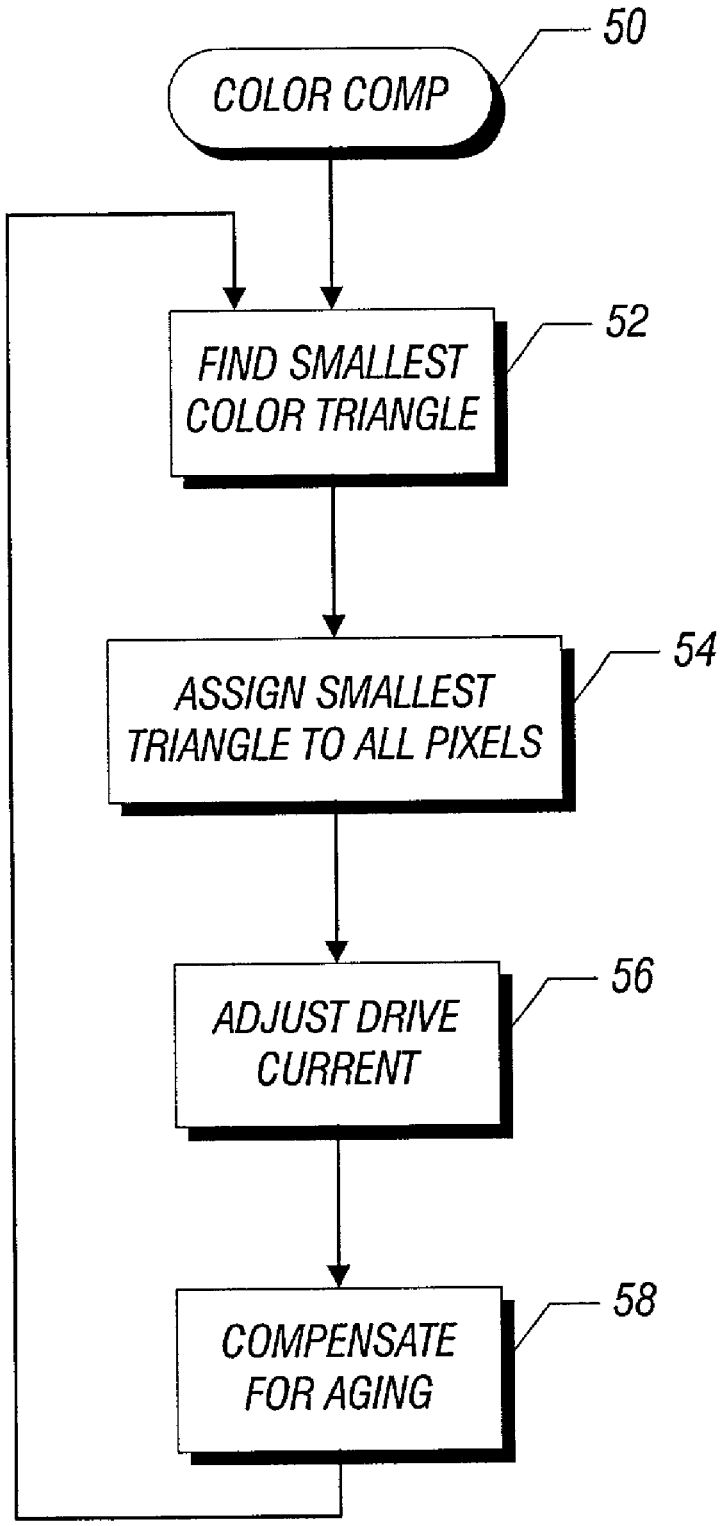
FIG. 4 is a hypothetical CIE x-y color chart in accordance with one embodiment of the present invention.

Referring to FIG. 4, in one embodiment the color compensation algorithm 50 begins by finding the smallest color gamut that all of the sub-pixels of an expressed color gamut may achieve as indicated in block 52. In other embodiments, a relatively small color gamut that can be achieved by a large percentage (e.g., 80 to 90%) of the sub-pixels of the expressed color gamut may be chosen. In such case, a given extent of color variation may be tolerated. The smallest (or smaller) gamut may be assigned to all of the sub-pixels as indicated in block 54. The drive current may then be adjusted to achieve the desired mix. In other words, the drive current may be adjusted to compensate for aging and to adjust the current within the given sub-pixels to achieve the color mix that results in a relatively constant color gamut.

In some embodiments, the actions set forth in blocks 52 and 54 can be done during manufacturing. In blocks 56 and 58 may be done in the field. In such embodiments, the flow may loop back from block 58 to block 56.

Thus, referring to FIG. 5, the aging effect on colors is shown indicating that the original color gamut 40 may move to the position shown at 42. In accordance with some embodiments of the present invention, the colors may be compensated to avoid the color shift and maintain the original color gamuts 40, 42 constant. Thus, the original color gamut 40, in one embodiment, may be the smallest color gamut that all of the sub-pixels can achieve. The tendency of that color gamut 40 to shift with aging can be resisted and the gamut 40 may be maintained substantially constant by appropriate color mixing over the lifetime of the display in accordance with one embodiment. In other embodiments, some shifting may be tolerated but the color gamut at any given time is maintained in accordance with the smallest gamut or a relatively small color gamut that all pixels can achieve. Thus, as indicated in block 58 of FIG. 4, the display is compensated for color aging in terms of total integrated charge as well as for the variation of sub-pixel colors with aging.

While the present invention has been described with respect to a limited number of embodiments, those skilled in the art will appreciate numerous modifications and variations therefrom. It is intended that the appended claims cover all such modifications and variations as fall within the true spirit and scope of this present invention.

What is claimed is:

1. A method comprising:

over the lifetime of an organic light emitting device display, determining a first color gamut that a substantial portion of the sub-pixels of an expressed color of the organic light emitting device display are able to achieve;

adjusting the drive current to the sub-pixels to achieve the first color gamut;

subsequently determining that a substantial portion of said sub-pixels can no longer achieve said first color gamut;

over the lifetime of an organic light emitting device display, determining a second color gamut that a substantial portion of the sub-pixels of an expressed color of the organic light emitting device display are able to achieve even though they cannot achieve the first color gamut any longer; and adjusting the drive current to the sub-pixels to achieve the second color gamut.

2. The method of claim 1 including determining a first color gamut that all of the subpixels of an expressed color gamut can achieve and adjusting the device current to achieve that color gamut.

3. The method of claim 1 including maintaining said first color gamut substantially constant by mixing a first or second subpixel color with an expressed color pixel to adjust the color of the expressed color pixel.

4. The method of claim 1 including mixing colors of a tricolor color space to achieve said first color gamut.

5. An article comprising a medium storing instructions that, if executed, enable a processor-based system to:

over the lifetime of an organic light emitting device display, determine a first color gamut that a substantial portion of the sub-pixels of an expressed color of the organic light emitting device display are able to achieve;

adjust the drive current to the sub-pixels to achieve the first color gamut;

subseciuently determine that a substantial portion of said sub-pixels can no longer achieve said first color gamut;

over the lifetime of an organic light emitting device display, determine a second color gamut that a substantial portion of the sub-pixels of an expressed color of the organic light emitting device display are able to achieve even though they cannot achieve the first color gamut any longer; and adjust the drive current to the sub-pixels to achieve the second color gamut.

6. The article of claim 5 further storing instructions that enable the processor-based system to determine a first color gamut that all of the sub-pixels of an expressed color gamut can achieve and adjust the drive current to achieve that color gamut.

7. The article of claim 5 further storing instructions that enable the processor-based system to maintain said gamut substantially constant by mixing a first or second sub-pixel color with an expressed color pixel to adjust the color of the expressed color pixel.

8. The article of claim 5 further storing instructions that enable the processor-based system to mix colors of a tri-color space to achieve said first color gamut.

9. An electrical system for an organic light emitting device display comprising:

a drive circuit to drive the pixels of said display;

a processor coupled to said drive circuit; and a storage coupled to said processor, said storage storing instructions that enable the processor to, over the lifetime of the organic light emitting device display, determine a first color gamut that a substantial portion of the sub-pixels of an expressed color gamut of the organic light emitting device display are able to achieve, adjust the drive current to the sub-pixels to achieve that first color gamut, subseciuently determine that a substantial portion of said sub-pixels can no longer achieve said first color gamut, determine a second color gamut that a substantial portion of the sub-pixels of an expressed color gamut of the organic light emitting device display are able to achieve even though they cannot achieve the first color gamut any longer, and adjust the drive current to the sub-pixels to achieve that second color gamut.

10. The system of claim 9 wherein said storage stores instructions that enable the system to determine a color gamut that all of the sub-pixels of an expressed color gamut can achieve and adjust the drive current to achieve that color gamut.

11. The system of claim 9 wherein said storage stores instructions that enable the system to maintain the gamut substantially constant by mixing a first or second sub-pixel color with an expressed color pixel to adjust the color of the expressed color pixel.

12. The system of claim 9 wherein said storage stores instructions that enable the system to mix colors of a ti-color color space to achieve said color gamut.

13. A display comprising:

a plurality of organic light emitting sub-pixels of at least three colors;

a drive circuit to drive said sub-pixels to emit light;

a controller to control said drive circuit to, over the lifetime of the organic light emitting device display, determine a first color gamut that a substantial portion of the sub-pixels of an expressed color gamut of said display are able to achieve and adjust the drive current to the sub-pixels to achieve that first color gamut;

subsecuently determine that a substantial portion of said sub-pixels can no longer achieve said first color gamut; and determine a second color gamut that a substantial portion of the sub-pixels of an expressed color gamut of said display are able to achieve and adjust the drive current to the sub-pixels to achieve that second color gamut even though they cannot achieve the first color gamut any longer.

14. The display of claim 13 wherein said sub-pixels include conjugated polymers.

15. The display of claim 13 wherein said sub-pixels include a film including small molecules.

16. The display of claim 13 wherein said display includes sub-pixels in the form of a stacked layer.

17. The display of claim 13 including a substrate wherein said sub-pixels are distributed side-by-side across said substrate.

18. The display of claim 13 wherein said controller determines a color gamut that all of the sub-pixels of an expressed color gamut can achieve and adjusts the drive current to achieve that color gamut.

* * * * *

UNITED STATES PATENT AND TRADEMARK OFFICE

CERTIFICATE OF CORRECTION

PATENT NO. : 7,027,015 B2
APPLICATION NO. : 09/945031
DATED : April 11, 2006
INVENTOR(S) : Lawrence A. Booth, Jr. and Robert F. Kwasnick It is certified that error appears in the above-identified patent and that said Letters Patent is hereby corrected as shown below:

Column 6:
Line 3, "subseciuently" should be --subsequently--;
Line 37, "subseciuently" should be --subsequently--;
Line 58, "ti-color" should be --tri-color--.

Column 7:
Line 3, "subsecuently" should be --subsequently--.

Signed and Sealed this

Twenty-second Day of August, 2006

JON W. DUDAS
*Director of the United States Patent and Trademark Office*